US006076988A

United States Patent [19]

You

[11] Patent Number: 6,076,988

[45] Date of Patent: Jun. 20, 2000

[54] CAP ASSEMBLY OF WRITING BRUSH

[76] Inventor: Jiun Feng You, No. 21, Alley 9, La. 27, Sec. 5, Min Sheng E. Rd., Taipei, Taiwan

[21] Appl. No.: 09/430,703

[22] Filed: Oct. 29, 1999

[51] Int. Cl.[7] ..... A46B 17/04; B43K 23/08

[52] U.S. Cl. ..... 401/269; 401/243; 401/246; 401/247

[58] Field of Search ..... 401/98, 202, 243, 401/246, 247, 262, 269

[56] References Cited

U.S. PATENT DOCUMENTS

| | | | |
|---|---|---|---|
| 1,423,448 | 7/1922 | O'Connor | 401/202 |
| 3,565,540 | 2/1971 | Andrews | 401/243 |
| 4,826,339 | 5/1989 | Sasaki | 401/269 |
| 5,340,228 | 8/1994 | Wilcox et al. | 401/262 |

FOREIGN PATENT DOCUMENTS

| | | | |
|---|---|---|---|
| 3619684 | 12/1987 | Germany | 401/202 |

*Primary Examiner*—Charles R. Eloshway
*Attorney, Agent, or Firm*—Rosenberg, Klein & Lee

[57] ABSTRACT

A cap assembly of a writing brush comprises a cap having a top opening, first and second circumferential recesses located below and adjacent to the top opening; and a collapsable sleeve having first and second end holes with first and second circumferential projections formed there-around respectively. The first projection is engaged with the first recess and the second projection is engaged with the second recess for permitting the point of the writing brush to insert into the cap in a first position. The second projection is extended toward the opening until covering and securing around handle of the writing brush for sealing the point of the writing brush within the cap and the sleeve in a second position.

5 Claims, 3 Drawing Sheets

CAP ASSEMBLY OF WRITING BRUSH

FIELD OF THE INVENTION

The present invention relates to a cap and more particularly to a cap assembly of a writing brush for keeping brush from drying.

BACKGROUND OF THE INVENTION

In general, a beginner tends to have troubles with writing brush. For example, ink spilled on hands, clothes or other things, not knowing how to put writing brush in a correct manner after use, brush separated from handle, and the whole brush loosened into at least two parts.

Thus, it is desirable to provide a novel cap assembly of a writing brush without the above drawbacks.

SUMMARY OF THE INVENTION

It is an object of the present invention to provide a cap assembly of a writing brush comprising a cap and a sealing sleeve for sealing point of writing brush in the cap assembly. By utilizing this, point of writing brush will not contact outside air, resulting in keeping brush from drying, aging, deforming, separating from handle, being bitten by worms, and frequently washing. Accordingly, such well kept writing brush is available to use in any time as well as saved in ink.

The above and other objects, features and advantages of the present invention will become apparent from the following detailed description taken with the accompanying drawings.

DETAILED DESCRIPTION OF THE PREFERRED EMBODIMENTS

Figure 1:
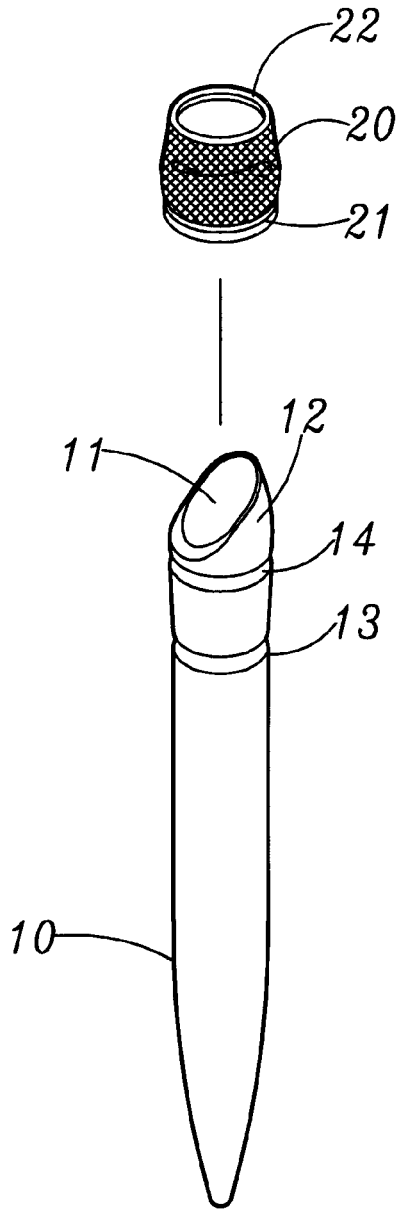
FIG. 1 is an exploded perspective view of a first embodiment of cap assembly of a writing brush of the present invention.
Figure 2:
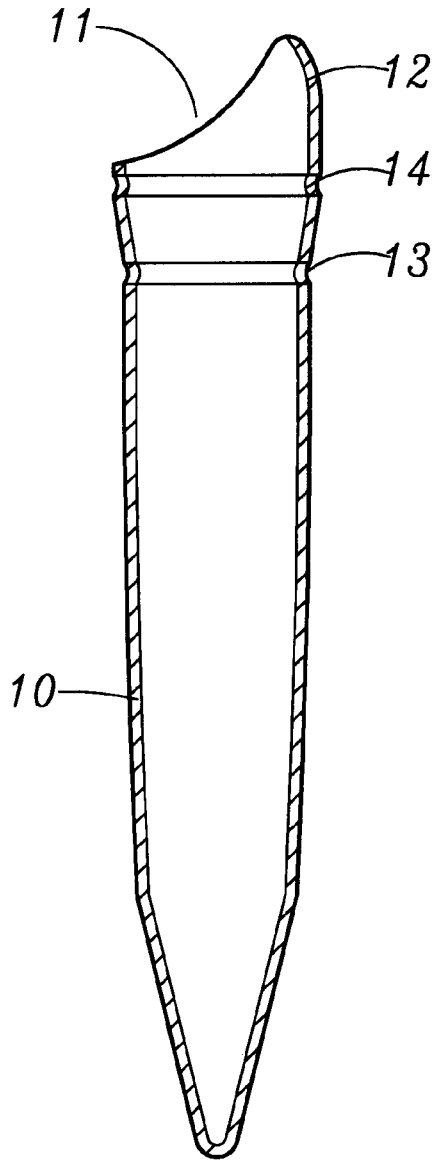
FIG. 2 is a cross-sectional view of cap of FIG. 1.

Referring to FIGS. 1–2, there is shown a cap assembly constructed in accordance with a first embodiment of the invention comprising a cap 10 and a mesh-like sealing sleeve 20. The body of cap 10 generally is a hollow cylinder-shaped member tapering toward the bottom with top portion extended to form a slanted hole 11. An outward curved guide surface 12 is formed on the circumference of slanted hole 11. A first circumferential recess 13 and a second circumferential recess 14 above the first circumferential recess 13 are located below and adjacent to slanted hole 11.

Sealing sleeve 20 is made of an elastomeric material such as rubber having top and bottom holes with second and first circumferential projections 22 and 21 formed therearound respectively.

Sealing sleeve 20 is collapsable in the direction from first circumferential projection 21 to second circumferential projection 22 and vice versa because of its elastic nature. Accordingly, sealing sleeve 20 is readily adapted to sleeve around slanted hole 11, i.e., first circumferential projection 21 is engaged with first circumferential recess 13 and second circumferential projection 22 is engaged with second circumferential recess 14 (see FIG. 3) or extended upward (see FIG. 4).

Figure 3:
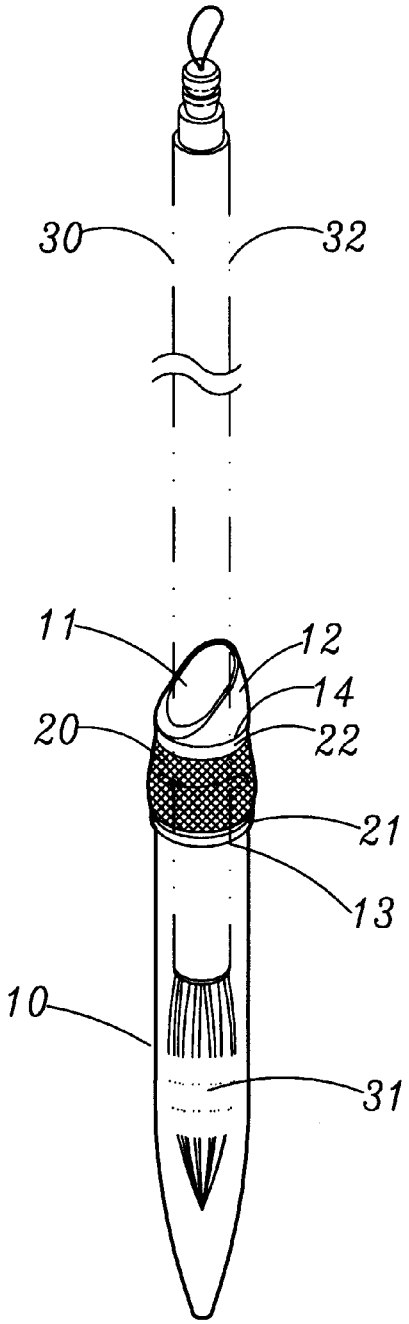
FIG. 3 is a front angled view of FIG. 1 with writing brush inserted into cap assembly but not sealed by sealing sleeve.
Figure 4:
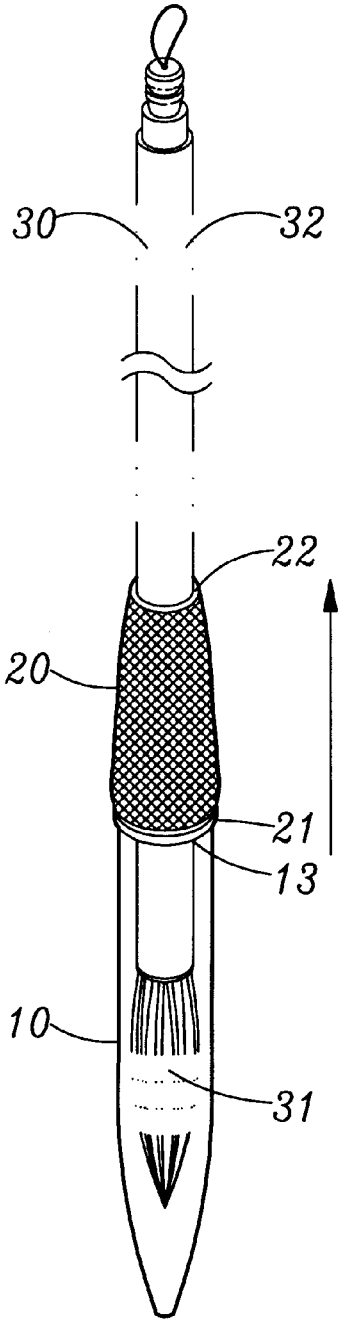
FIG. 4 is a front angled view of FIG. 1 with writing brush inserted and sealed in the cap assembly.

In the case shown in FIG. 3, point 31 of writing brush 30 after used while not cleaned can be inserted into cap 10 directly. Then pull second circumferential projection 22 upward to make sealing sleeve 20 in an extended position and thus second circumferential projection 22 is sleeved around handle 32 of writing brush 30 as shown in FIG. 4. As a result, point 31 of writing brush 30 is sealed in the cap 10 and sealing sleeve 20.

Before using writing brush 30, pull second circumferential projection 22 down to pass through the guide surface 12 for engaging with second circumferential recess 14 as shown in FIG. 3. As a result, sealing sleeve 20 is collapsed and not in contact with writing brush 30. Thus, user can move point 31 of writing brush 30 freely from slanted hole 11 of cap 10 because sealing sleeve 20 is out of engagement with writing brush 30.

Figure 5:
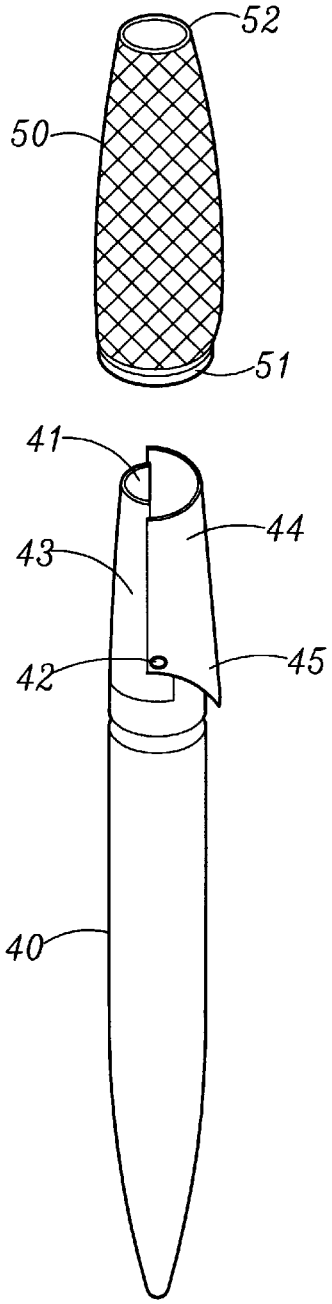
FIG. 5 is an exploded perspective view of a second embodiment of cap assembly of a writing brush of the present invention.
Figure 6:
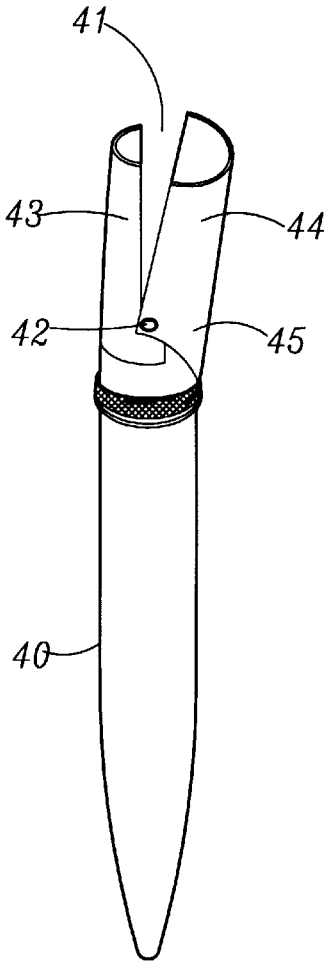
FIG. 6 is an exploded perspective view of FIG. 5 with sealing sleeve collapsed to the bottom portion thereof.
Figure 7:
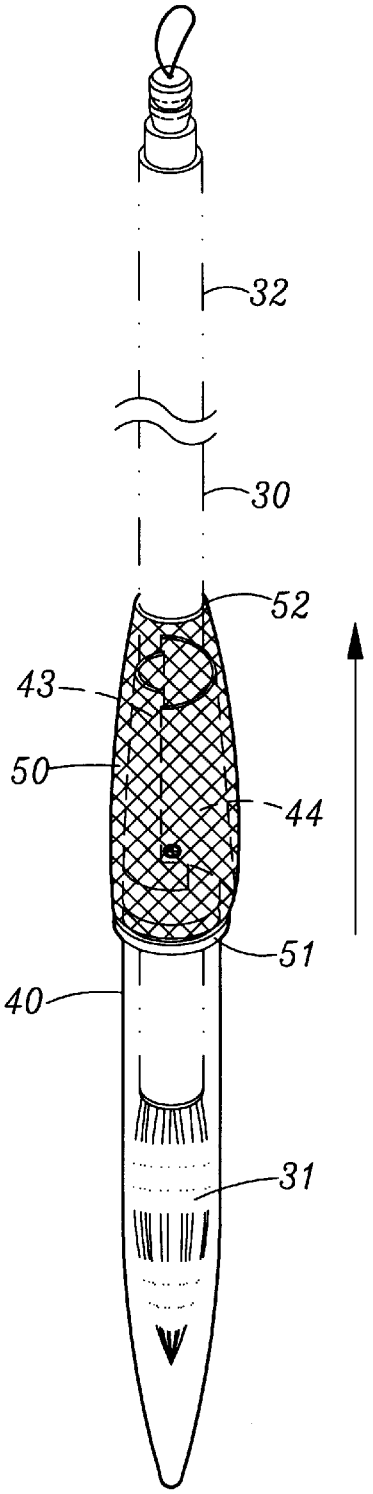
FIG. 7 is an exploded perspective view of FIG. 5 with writing brush inserted and sealed in the cap assembly.

FIGS. 5–7, illustrate a cap assembly of a writing brush constructed in accordance with a second embodiment of the invention comprising a cap 40 and a mesh-like sealing sleeve 50. The body of cap 40 generally is a hollow cylinder-shaped member tapering toward the bottom with top portion extended to form an opening 41. The top portion of cap 40 consists of a first half fixed member 43 and a second half pivotal member 44 pivotable with respect to first half fixed member 43 about two pivot points 42 near the bottom of two opposing sides of first half fixed member 43. In other words, second half pivotal member 44 may pivot toward first half fixed member 43 to form a narrow opening 41 (see FIG. 5), or pivot away from first half fixed member 43 to form a wide opening 41 until a tip of extension portion 45 of second half pivotal member 44 is in contact with cap 40 (see FIG. 6).

Similarly, sealing sleeve 50 is made of an elastomeic material such as rubber having top and bottom holes with a second and a first circumferential projections 52 and 51 formed therearound respectively.

Sealing sleeve 50 is collapsable in the direction from first circumferential projection 51 to second circumferential projection 52 and vice versa because of its elastic nature. Accordingly, sealing sleeve 50 is readily adapted to sleeve around opening 41, i.e., first circumferential projection 51 is engaged around top of cap 40 just below first half member 43 and secured there (see FIG. 6), and second circumferential projection 52 is also engaged around top of cap 40 just above first circumferential projection 51 to cover the tip of extension portion 45. The second half pivotal member 44 may extend upward (see FIG. 7).

In the case shown in FIG. 6, point 31 of writing brush 30 after used while not cleaned can be inserted into cap 40 directly because second half pivotal member 44 has pivoted away from first half fixed member 43 about pivot axes 42 to form a wide opening 41 with tip of extension portion 45 of second half pivotal member 44 being covered and secured by second circumferential projection 52. Then pull second circumferential projection 52 upward to force second half pivotal member 44 to pivot toward first half fixed member 43 about pivot axes 42 to form a narrow opening 41 in which first and second half members 43 and 44 are completely enclosed by sealing sleeve 50 in an extended position and thus second circumferential projection 52 is sleeved around handle 32 of writing brush 30 as shown in FIG. 7. As a result, point 31 of writing brush 30 is sealed in the cap 40 and sealing sleeve 50.

Before using writing brush 30, pull second circumferential projection 52 down to pass through first and half members 43 and 44 until covering and securing the tip of extension portion 45 of second half pivotal member 44 as shown in FIG. 6. As a result, sealing sleeve 50 is collapsed and not in contact with writing brush 30. Thus, user can move point 31 of writing brush 30 freely from opening 41 of cap 40 because sealing sleeve 50 is out of engagement with writing brush 30.

ADVANTAGES OVER THE PRIOR ART

By utilizing this cap assembly, point of writing brush will not contact outside air, resulting in keeping brush from drying, aging, deforming, separating from handle, being bitten by worms, and frequently washing. Accordingly, such well kept writing brush is available to use in any time as well as saved in ink.

While the invention herein disclosed has been described by means of specific embodiments, numerous modifications and variations could be made thereto by those skilled in the art without departing from the scope of the invention set forth in the claims.

What is claimed is:

1. A cap assembly of a writing brush having a point and a handle comprising:

a cap having a top portion extended to form an opening and a closed bottom portion, a first circumferential recess and a second circumferential recess above the first circumferential recess both located below and adjacent to the opening; and a hollow collapsable cylindrical sealing member having a first end hole and a second end hole with a first circumferential projection and a second circumferential projection formed therearound respectively;

wherein the first circumferential projection is engaged with the first circumferential recess and the second circumferential projection is engaged with the second circumferential recess for permitting the point of the writing brush to insert into the cap in a first position, and the second circumferential projection is extended toward the opening until covering and securing around the handle of the writing brush for sealing the point of the writing brush within the cap and sealing member in a second position.

2. The cap assembly of claim 1, wherein the cap is a hollow cylinder-shaped member tapering toward the bottom portion.

3. The cap assembly of claim 1, wherein the opening is of slanted shape.

4. The cap assembly of claim 1, further comprising an outward curved guide surface formed on a circumference of the top portion of the cap.

5. A cap assembly of a writing brush having a point and a handle comprising:

a cap having a top portion extended to form an opening and a closed bottom portion, the top portion of the cap consisting of a first half fixed member and a second half pivotal member pivotable with respect to the first half fixed member about two pivot points on a bottom portion of two opposing sides of the first half fixed member, the second half pivotal member having a portion protruded downward to form an extension; and a hollow collapsable cylindrical sealing member having a first end hole and a second end hole with a first circumferential projection and a second circumferential projection formed therearound respectively;

wherein the first circumferential projection is engaged around the top portion of the cap below the first half fixed member and the second circumferential projection is in covering relation with the extension for securing therearound so as to permit the point of the writing brush to insert into the cap in a first position, and the second circumferential projection is extended toward the opening until covering the first and second half members and securing around the handle of the writing brush for sealing the point of the writing brush within the cap and sealing member in a second position.

* * * * *